US007179363B2

(12) United States Patent
DiMascio et al.

(10) Patent No.: US 7,179,363 B2
(45) Date of Patent: Feb. 20, 2007

(54) ELECTROLYTIC PROCESS FOR GENERATING CHLORINE DIOXIDE

(75) Inventors: Felice DiMascio, Rocky Hill, CT (US); Mike Hunter, Workingham Berkshire (GB)

(73) Assignee: Halox Technologies, Inc., Bridgeport, CT (US)

( * ) Notice: Subject to any disclaimer, the term of this patent is extended or adjusted under 35 U.S.C. 154(b) by 428 days.

(21) Appl. No.: 10/604,712

(22) Filed: Aug. 12, 2003

(65) Prior Publication Data

US 2005/0034997 A1 Feb. 17, 2005

(51) Int. Cl.
*C25B 1/26* (2006.01)

(52) U.S. Cl. ..... 205/556; 205/500

(58) Field of Classification Search ..... 205/556, 205/500

See application file for complete search history.

(56) References Cited

U.S. PATENT DOCUMENTS 2,717,237 A 9/1955 Rempel
3,386,915 A 6/1968 Rutschi et al.
3,684,437 A 8/1972 Callerame
3,763,006 A 10/1973 Callerame
3,878,072 A 4/1975 Cook, Jr. et al.
3,884,777 A 5/1975 Harke et al.
3,904,496 A 9/1975 Harke et al.
4,115,217 A 9/1978 Larsson et al.
4,234,446 A 11/1980 Ramras
4,250,144 A 2/1981 Ratigan
4,308,117 A 12/1981 Sweeney
4,362,707 A 12/1982 Hardee et al.
4,381,290 A 4/1983 Hardee et al.
4,426,263 A 1/1984 Hardee et al.
4,432,856 A 2/1984 Murakami et al.
4,542,008 A 9/1985 Capuano et al.
4,632,876 A 12/1986 Laird et al.
4,683,039 A 7/1987 Twardowski et al.
4,725,390 A 2/1988 Laird et al.
4,767,510 A 8/1988 Lipsztajn
4,806,215 A 2/1989 Twardowski
4,853,096 A 8/1989 Lipsztajn et al.
5,008,096 A 4/1991 Ringo
5,041,196 A 8/1991 Cawlfield et al.
5,077,258 A 12/1991 Phillips et al.
5,078,908 A 1/1992 Ripley et al.
5,084,149 A 1/1992 Kaczur et al.
5,092,970 A * 3/1992 Kaczur et al. ..... 205/556
5,106,465 A * 4/1992 Kaczur et al. ..... 205/338
5,158,658 A 10/1992 Cawlfield et al.
5,242,552 A 9/1993 Coin et al.
5,242,553 A 9/1993 Kaczur et al.
5,248,397 A 9/1993 Cawlfield et al.
5,264,089 A 11/1993 Kaczur et al.
5,296,108 A 3/1994 Kaczur et al.
5,348,659 A 9/1994 Kunz et al.
5,354,435 A 10/1994 Kaczur et al.
5,391,533 A 2/1995 Peterson et al.
5,419,816 A 5/1995 Sampson et al.

(Continued)

*Primary Examiner*—Arun S. Phasge
(74) *Attorney, Agent, or Firm*—Cantor Colburn LLP

(57) ABSTRACT

An electrolytic process for generating chlorine dioxide. An aqueous feed stream of an alkali metal chlorite solution is treated with chlorine gas or a mixture of hydrogen chloride and hypochlorous acid formed in an anode compartment from, an aqueous alkali metal chloride solution and subsequently electrolyzed to form a chlorine dioxide effluent.

19 Claims, 4 Drawing Sheets

U.S. PATENT DOCUMENTS 5,435,984 A 7/1995 Daly et al.
5,609,742 A * 3/1997 Sampson et al. ..... 204/536
5,705,050 A 1/1998 Sampson et al.
5,858,191 A 1/1999 DiMascio et al.
5,858,246 A 1/1999 Rafter et al.
5,868,915 A 2/1999 Ganzi et al.
6,024,850 A 2/2000 Sampson et al.
6,171,485 B1 1/2001 Kuke
6,203,688 B1 3/2001 Lipsztajn et al.
6,265,343 B1 7/2001 Daly et al.
6,294,108 B1 9/2001 Speronello et al.
2001/0005499 A1 6/2001 Ostgard

* cited by examiner

ELECTROLYTIC PROCESS FOR GENERATING CHLORINE DIOXIDE

BACKGROUND

This disclosure relates to an electrochemical method, more particularly, relates to an oxidation and reduction process and even more particularly, relates to a process for producing chlorine dioxide.

With the decline of gaseous chlorine as a microbiocide and bleaching agent, various alternatives have been explored, including bleach, bleach with bromide, bromochlorodimethyl hydantoin, ozone, and chlorine dioxide ($ClO_2$). Of these, chlorine dioxide has generated a great deal of interest for control of microbiological growth in a number of different industries, including the dairy industry, the food and beverage industry, the pulp and paper industries, the fruit and vegetable processing industries, various canning plants, the poultry industry, the beef processing industry and miscellaneous other food processing applications. Chlorine dioxide is also seeing increased use in municipal potable water treatment facilities, potable water pathogen control in office building and healthcare facilities, industrial cooling loops, and in industrial waste treatment facilities, because of its selectivity towards specific environmentally-objectionable waste materials, including phenols, sulfides, cyanides, thiosulfates, and mercaptans. In addition, chlorine dioxide is being used in the oil and gas industry for downhole applications as a well stimulation enhancement additive.

Unlike chlorine, chlorine dioxide remains a gas when dissolved in aqueous solutions and does not ionize to form weak acids. This property is at least partly responsible for the biocidal effectiveness of chlorine dioxide over a wide pH range, and makes it a logical choice for systems that operate at alkaline pHs or that have poor pH control. Moreover, chlorine dioxide is a highly effective microbiocide at concentrations as low as 0.1 parts per million (ppm) over a wide pH range.

The biocidal activity of chlorine dioxide is believed to be due to its ability to penetrate bacterial cell walls and react with essential amino acids within the cell cytoplasm to disrupt cell metabolism. This mechanism is more efficient than other oxidizers that "burn" on contact and is highly effective against legionella, algae and amoebal cysts, giardia cysts, coliforms, salmonella, shigella, and cryptosporidium.

Unfortunately, chlorine dioxide can become unstable and hazardous under certain temperature and pressure conditions. Although this is only an issue of concern for solutions of relatively high concentration, its shipment, at any concentration, is banned. It is for this reason that chlorine dioxide is always generated on-site, at the point of use, usually from a metal chlorate or metal chlorite as an aqueous solution. For example, a metal chlorite solution mixed with a strong acid can be used to generate chlorine dioxide in situ.

Electrochemical processes provide a means for generating chlorine dioxide for point of use applications. For example, U.S. Pat. No. 5,419,816 to Sampson et al. describes a packed bed ion exchange electrolytic system and process for oxidizing species in dilute aqueous solutions by passing the species through an electrolytic reactor packed with a monobed of modified cation exchange material. A similar electrolytic process is described in U.S. Pat. No. 5,609,742 to Sampson et al. for reducing species using a monobed of modified anion exchange.

One difficulty with electrochemical processes is that it can be difficult to control the generation of undesirable species. For example, there are many electrochemical reactions that can occur at the anode. Within a potential range of 0.90 to 2.10 volts, at least eight different reactions are thermodynamically possible, producing products such as chlorate ($ClO_3^-$), perchlorate ($ClO_4^-$), chlorous acid ($HClO_2$), oxygen ($O_2$), hydrogen peroxide ($H_2O_2$) and ozone ($O_3$). It is highly desirable and a significant commercial advantage for an apparatus to allow for careful control of the products generated to achieve high yield efficiency.

Chlorine dioxide has also been produced from a chlorine dioxide precursor solution by contacting the precursor solution with a catalyst (e.g., catalysts containing a metal such as those catalysts described for example in U.S. Pat. No. 5,008,096) in the absence of an electrical field or electrochemical cell. However, known catalytic processes have the disadvantage of becoming greatly deactivated within a matter of days. Moreover, it has been found that the support materials for the catalytic sites tend to quickly degrade due to the oxidizing nature of chlorine dioxide. Still further, the use of catalyst materials in packed columns or beds for generating chlorine dioxide has been found to cause a significant pressure drop across the column or form channels within the column that results in a significant decrease in conversion efficiency from the chlorine dioxide precursor to chlorine dioxide. It is also noted that catalyst materials are relatively expensive and can add significant cost to an apparatus employing these materials.

BRIEF SUMMARY

Disclosed herein is a process for generating chlorine dioxide. The process comprises feeding an aqueous alkali metal chloride solution into an anode compartment of an electrolytic reactor, wherein the electrolytic reactor comprises the anode compartment comprising an anode, a cathode compartment comprising a cathode, and a central compartment positioned between the anode and cathode compartments, wherein the central compartment comprises a particulate material; feeding an effluent from the anode compartment and an aqueous alkali metal chlorite solution into the central compartment of an electrolytic reactor; and applying a current to the electrolytic reactor to produce an effluent containing chlorine dioxide from the central compartment.

In another embodiment, the process comprises applying a current to an electrolytic reactor, wherein the electrolytic reactor includes an anode compartment comprising an anode, a cathode compartment comprising a cathode, and a central compartment positioned between the anode and cathode compartments, wherein the central compartment comprises a cation exchange material and is separated from the cathode compartment with a cation exchange membrane; feeding an aqueous sodium chloride solution to the anode compartment; electrolyzing the aqueous sodium chloride solution in the anode compartment to produce a hydrogen chloride and/or a hypochlorous acid containing effluent; and feeding the hydrogen chloride and/or the hypochlorous acid containing effluent and an alkali metal chlorite solution into the central compartment to produce a chlorine dioxide effluent from the central compartment.

In yet another embodiment, the process for producing chlorine dioxide from an alkali metal chlorite solution comprises applying a current to an electrolytic reactor, wherein the electrolytic reactor includes an anode compartment comprising an anode, a cathode compartment comprising a cathode, and a central compartment positioned between the anode and cathode compartments, wherein the central compartment comprises a cation exchange material and is separated from the cathode compartment with a cation exchange membrane; feeding an aqueous sodium chloride solution to the anode compartment; electrolyzing the aqueous sodium chloride solution in the anode compartment to produce a chlorine gas containing effluent; and feeding the chlorine gas containing effluent and an alkali metal chlorite solution into the central compartment to produce a chlorine dioxide containing effluent from the central compartment.

The above-described embodiments and other features will become better understood from the detailed description that is described in conjunction with the accompanying drawings.

BRIEF DESCRIPTION OF THE DRAWINGS

Referring now to the figures wherein the like elements are numbered alike.

DETAILED DESCRIPTION OF THE PREFERRED EMBODIMENTS

A process for producing halogen oxide from alkali metal halite solutions are disclosed, such as, for example, a process for producing chlorine dioxide from an alkali metal chlorite solution. The process generally includes employing a multi-compartment electrolytic reactor for producing an aqueous effluent containing halous acid and hydrogen halide from an aqueous alkali metal halide solution, which effluent is then combined with an alkali metal halite feedstream for converting the alkali metal halite to halogen oxide. In a preferred embodiment, the alkali metal halite is an aqueous alkali metal chlorite solution whereas the hydrogen halide and the halous acid are preferably electrolytically produced from an aqueous sodium chloride solution. In this preferred embodiment, a chlorine dioxide product is produced, wherein the chlorine dioxide product contains at least 90 percent by weight of chlorine dioxide relative to all chlorine species produced in the chlorine dioxide product.

In a more preferred embodiment, the alkali metal chlorite solutions are dilute solutions. The term "dilute" refers to aqueous alkali metal chlorite solutions containing less than about 10.0 grams alkali metal chlorite per liter of solution (g/L), preferably less than about 5.0 g/L, and more preferably less than about 1.5 g/L. For industrial use, the alkali metal chlorite solution is preferably in the form of a 25% aqueous solution in view of handling properties, safety issues, and the like, which can be further diluted during use. Suitable alkali metals include sodium, potassium, lithium, and the like, with preference given to sodium salt considering the commercial availability.

The term "alkali metal halide solution" preferably refers to aqueous sodium chloride solutions containing less than about 20.0 grams sodium chloride per liter of solution (g/L), with less than about 10.0 g/L more preferred, and with less than about 1.0 g/L even more preferred. For industrial use, the sodium chloride solution is preferably in the form of a brine solution, containing at least 20% sodium chloride (w/w).

Figure 1:
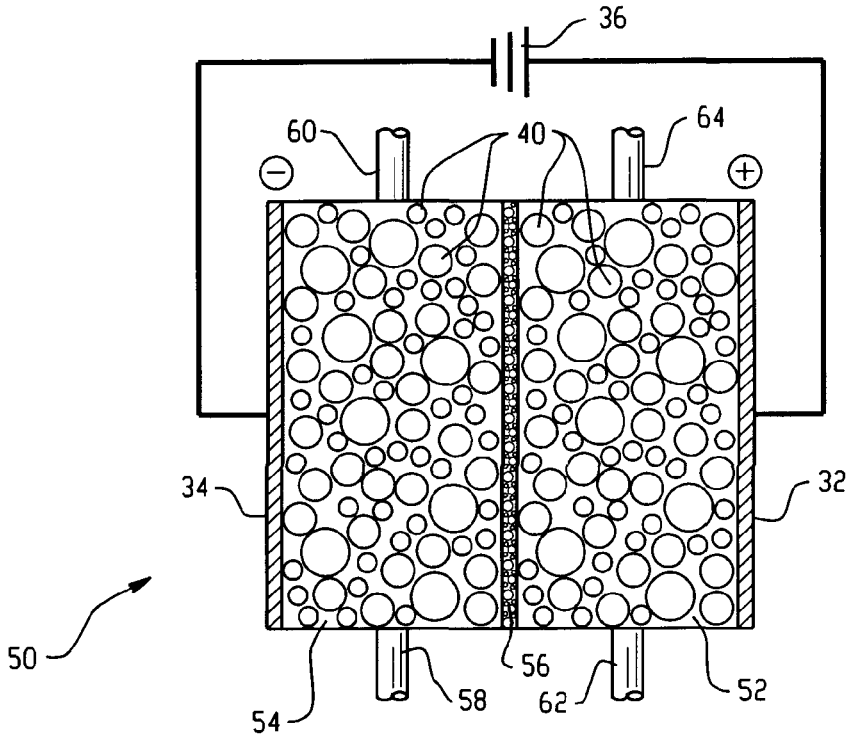
FIG. 1 shows a cross sectional view illustrating an two-compartment electrolytic reactor.
Figure 2:
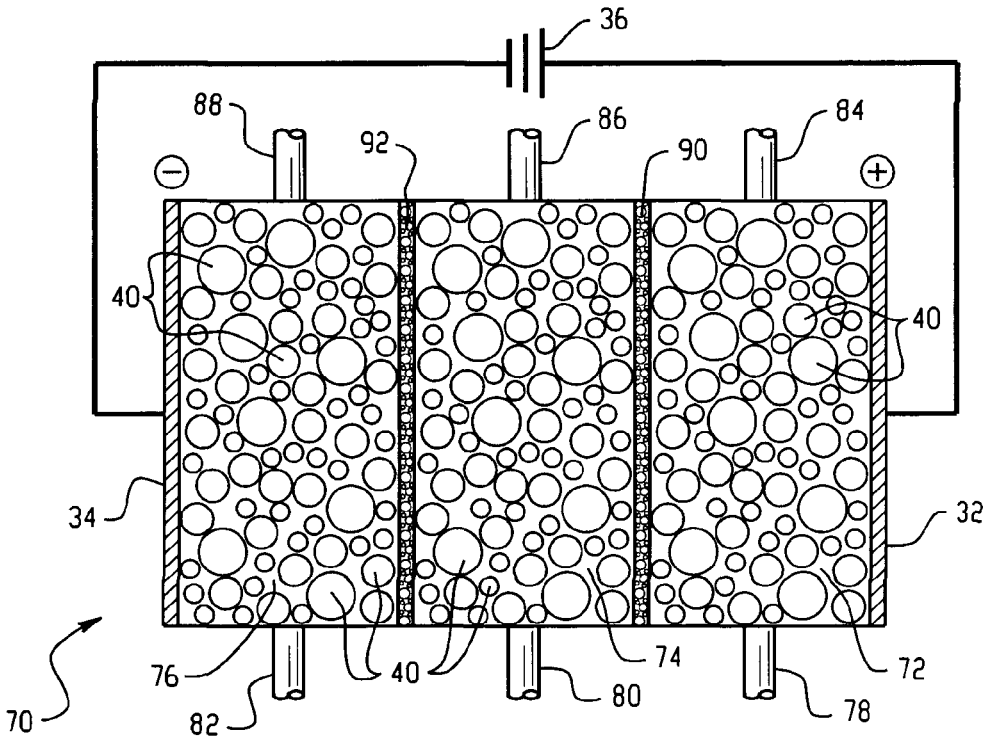
FIG. 2 shows a cross sectional view illustrating an multi-compartment electrolytic reactor.

Suitable multi-compartment electrolytic reactors include a two-compartment reactor 50 as shown in FIG. 1, or a reactor containing three or more compartments. An exemplary multi-compartment electrolytic reactor 70 configured with three compartments is shown in FIG. 2.

Referring now to FIG. 1, the two-compartment electrolytic reactor 50 includes an anode 32, an anode compartment 52, a cathode 34, and a cathode compartment 54, wherein the anode 32 and cathode 34 are in electrical communication with a source of direct current 36 (DC). A membrane 56 preferably separates the anode compartment 52 from the cathode compartment 54. The anode compartment 52 further includes inlet 58 and outlet 60. Similarly, the cathode compartment 54 includes inlet 62 and outlet 64.

As used herein, the term "membrane" generally refers to a sheet for separating adjacent compartments, e.g., compartments 52 and 54. In this regard, the term "membrane" can be used interchangeably with screen, diaphragm, partition, barrier, a sheet, a foam, a sponge-like structure, a canvas, and the like. The membrane 56 can be chosen to be permselective, e.g., a cation exchange membrane, or can be chosen to be non-permselective, e.g., a porous membrane. As used herein, the term "permselective" refers to a selective permeation of commonly charged ionic species through the membrane with respect to other diffusing or migrating ionic species having a different charge in a mixture. In contrast, the term "non-permselective" generally refers to a porous structure that does not discriminate among differently charged ionic species as the species pass through the porous structure, i.e., the membrane is non-selective with respect to ionic species. For example, in a permselective membrane such as a cation exchange membrane, cations can freely pass through the membrane whereas the passage of anions is prevented. In contrast, in a non-permselective membrane such as a porous membrane, the passage of anions and cations through the porous membrane are controlled by diffusion.

As will be discussed in greater detail below, an alkali metal chloride solution is fed to the anode compartment. The effluent produced in the anode compartment is fed into the cathode compartment inlet 58 along with an alkali metal chlorite solution to produce a chlorine dioxide product containing effluent.

FIG. 2, wherein like elements are numbered alike, illustrates an exemplary multi-compartment electrolytic reactor 70 configured with three compartments. The three-compartment electrolytic reactor 70 generally comprises an anode compartment 72, a central compartment 74, and a cathode compartment 76. The central compartment 74 is interposed between the anode and cathode compartments 72, 76, respectively, and is separated therefrom by membranes 90 and 92. Each compartment 72, 74, and 76, preferably includes inlets 78, 80, 82, respectively, and outlets 84, 86, and 88, respectively. The anode compartment 72 includes anode 32 and can be optionally filled with the particulate material 40. The cathode compartment 76 includes cathode 34 and can be optionally filled with the particulate material 40. The anode 32 and cathode 34 are in electrical communication with a source of direct current 36 (DC).

As used herein, the term "particulate material" refers to a cation exchange material and/or an anion exchange material. Any cation exchange material can be used provided portions of its active sites are occupied with hydrogen, i.e., cation exchange material in the hydrogen form. In a preferred embodiment, the particulate material 40 in compartment 38 includes the cation exchange material or a mixture of the cation exchange material and the anion exchange material. In the case of mixtures of the cation and anion exchange materials, the majority of the particulate material 40 within compartment 38 is preferably the cation exchange material. The particulate material 40 may also include an additive or additives to achieve certain results. For example, electrically conductive particles, such as carbon and the like, can be used to affect the transfer of DC current across electrodes. However, some additives, such as carbon, are prone to disintegration in acidic environments, thus requiring careful selection.

More preferably, the particulate material comprises a catalyst material. The term "catalyst material" refers to a support and an active metal catalyst. Preferably, the active metal catalyst is finely and discretely deposited onto the support. In a preferred embodiment, the active metal catalyst is a noble metal. While not wanting to be bound by theory, it is believed that the catalytic activity of the active metal is associated with crystal imperfections and the finely divided deposits help to increase the surface area as well as increase the number of active catalytic sites. Suitable active metal and active metal oxide catalysts include, but are not limited to, metals of Groups of 4a, 4b, 5b, 6b, 7, and 8 of the Periodic Table of Elements, and composites or mixtures or alloys of at least one of the foregoing metal catalysts. Preferably, the active metal catalyst is an oxide of a metal selected from the group consisting of transition metals of Group 8 of the Periodic Table of Elements. More preferably, the active metal catalyst is a platinum oxide.

In another embodiment, the active metal catalyst and active metal oxides are transition metals of Group 8 of the Periodic Table of Elements, or mixtures or alloys of at least one of the foregoing transition metals and a less active metal or metal oxide of a including metals from Groups of 4a, 4b, 5b, 6b, and 7 of the Periodic Table of Elements, or mixtures, or alloys of at least one of the foregoing metals. Preferably, the molar ratio of the active metal catalyst to the less active metal catalyst is of about 0.3:1 to about 100:1. More preferably, the molar ratio of the active metal catalyst to the less active metal catalyst is about 10:1.

Suitable supports for the catalyst material include metals, zeolites, anthracite, glauconite, faujasite, mordenite, clinoptilolite, aluminas, silicas, clays, ceramics, carbon and the like. Of these supports, ceramics are most preferred. In a preferred embodiment, the catalyst materials are made from those ceramics described in U.S. Pat. Nos. 4,725,390 and 4,632,876, herein incorporated by reference in their entireties. Preferred ceramics are those made essentially from nonmetallic minerals (such as mineral clays) by firing at an elevated temperature. More preferred are ceramic materials commercially available under the trade name MACROLITE® by the Kinetico Company. The MACROLITE® ceramic materials are spherically shaped and characterized by having a rough texture, high surface area, and level of moisture absorption of less than about 0.5%. The low level of moisture absorption allows for the metal oxide precursor solution to penetrate a minimal depth into the surface of the ceramic, thereby depositing metal onto the external surface of the support, an optimum location for subsequent contact with an aqueous solution. The surface area of the MACROLITE® ceramic materials is believed to be on the order of about 103 $m^2$ per gram.

Figure 3A:
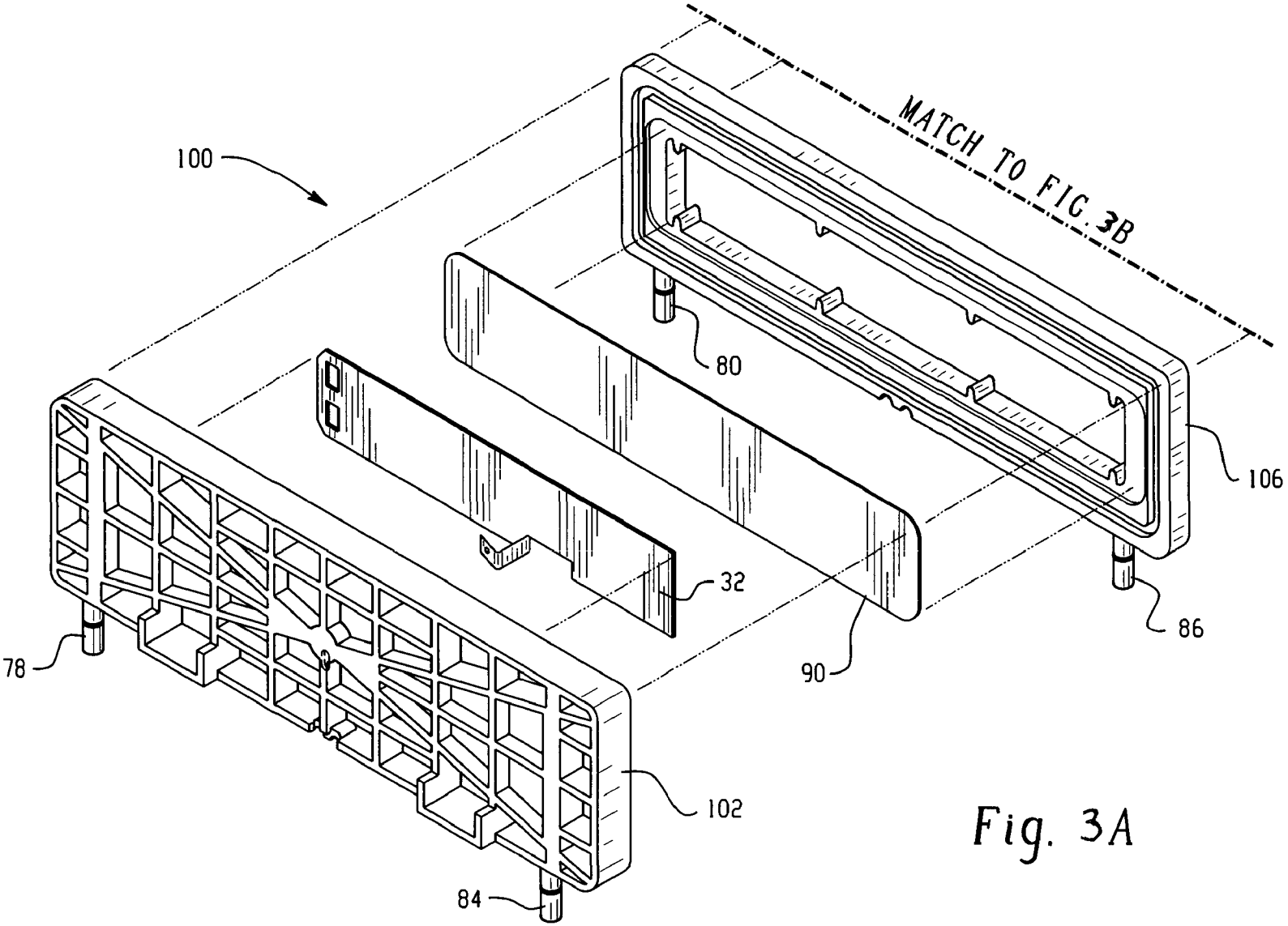
FIGS. 3A and 3B show an exploded isometric view of an electrolytic reactor cassette employing the multi-compartment reactor of FIG. 1.
Figure 3B:
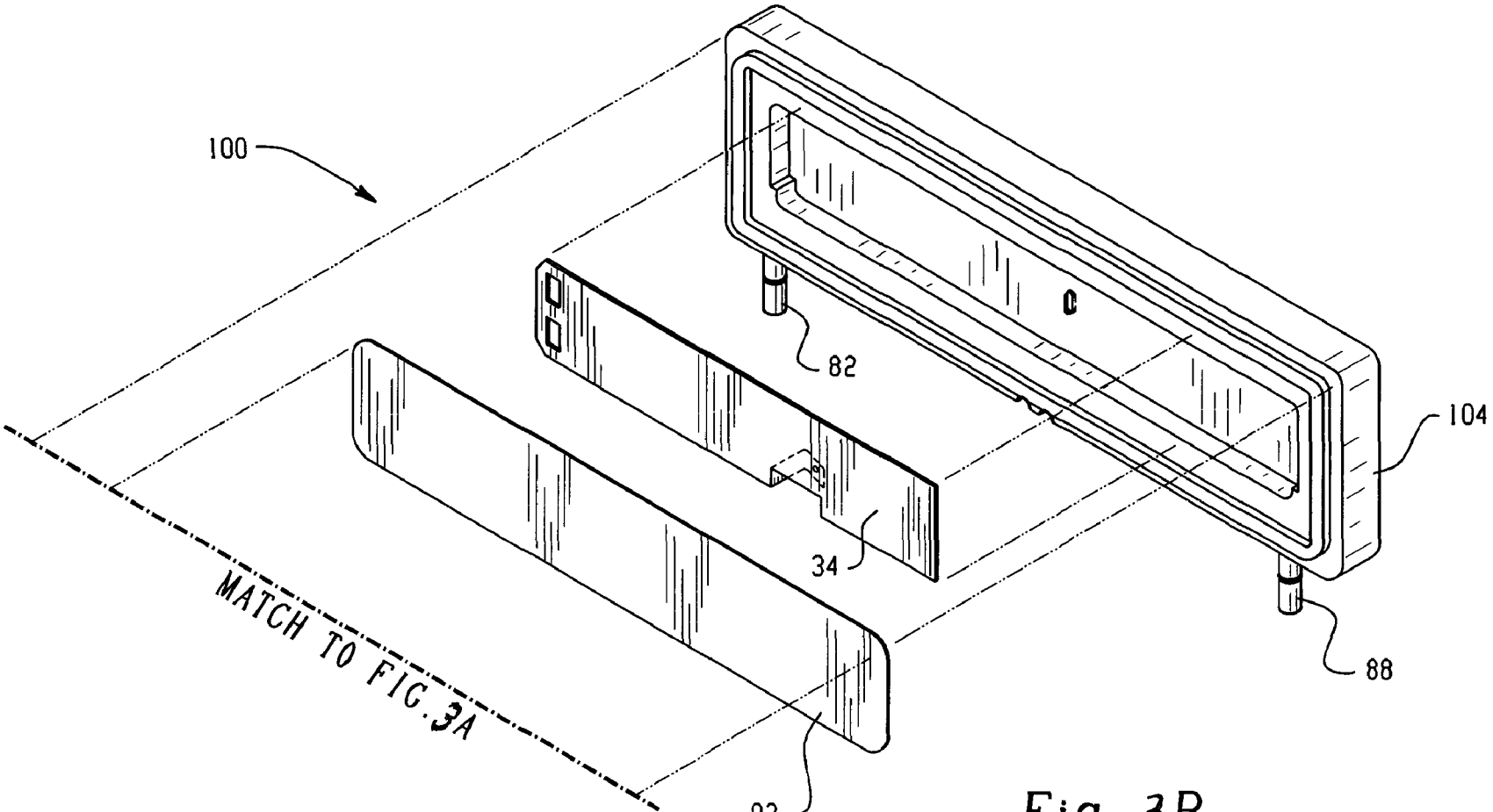

Referring now to FIGS. 3A and 3B, there is shown an exploded isometric view of an exemplary electrolytic reactor cassette 100 employing the three-compartment reactor configuration 70 as described in relation to FIG. 2. The cassette 100 is formed from stock materials that are preferably chemically inert and non-conductive. Components forming the cassette 100 may be molded for high volume production or alternatively, may be machined as described in further detail below.

The exemplary cassette 100 is configured for producing about 5 grams per hour of chlorine dioxide and is fabricated from two pieces of flat stock 102 and 104, about 4 inches across by about 14 inches long by about 1 inch thick. The pieces 102, 104 are machined such that depressions ¼ inch deep by 2 inches across by 12 inches long are cut in the center of each piece. The pieces 102, 104 are then drilled and tapped to accept the anode 32 and cathode 34. Each piece further includes inlets 78, 82 and outlets 84, 88, through which fluid would flow. The anode 32 and cathode 34 are approximately 2 inches across by 9 inches long and are inserted into the stock pieces 102 and 104. Membranes 90, 92 are disposed over each depression formed in stock pieces 102, 104. Preferably, membrane 90 is a cation exchange membrane. Approximately 150 ml of particulate material (not shown) may optionally be packed into each depression to form the anode compartment 72 and the cathode compartment 76, respectively (as shown in FIG. 2). As constructed, the particulate material, if present in the cathode and/or anode compartments, is configured to be in direct contact with the anode 32 or cathode 34.

Interposed between the membranes 90, 92 is a piece of flat stock 106, about 4 inches across by about 14 inches long by 1 inch thick. The stock piece 106 is machined such that a hole about 2 inches across by 12 inches long is cut through the piece to form the central compartment 74 (as shown in FIG. 2). The piece 106 is then drilled and tapped to accept two fittings that form inlet 80 and outlet 86 through which fluid would flow. The central compartment 74 is filled with about 150 ml of particulate material that includes the cation exchange material. The components of the electrolytic reactor cassette 100 are assembled and bolted together, or otherwise secured. In this configuration, the aqueous alkali metal halite solution (e.g., alkali metal chlorite) is preferably passed through the central compartment 74 and is not in direct contact with the anode 32 or cathode 34. In contrast, the sodium chloride solution that is fed into the anode compartment 72 is in direct contact with the anode 32.

In a preferred embodiment, the cassette 100 is formed from an acrylonitrile-butadiene-styrene (ABS) terpolymer.

Other suitable materials include polyvinylchloride (PVC), chlorinated PVC, polyvinylidene difluoride, polytetrafluoroethylene and other fluoropolymer materials.

Other embodiments include, but are not limited to, separation of the anode and cathode compartments to control intermixing of gases and solutions and provision of any number of packed-bed compartments separated by membranes placed between the anode and cathode to affect other oxidation, reduction or displacement reactions.

The anode 32 and the cathode 34 may be made of any suitable material based primarily on the intended use of the electrolytic reactor, costs and chemical stability. For example, the anode 32 may be made of a conductive material, such as ruthenium, iridium, titanium, platinum, vanadium, tungsten, tantalum, oxides of at least one of the foregoing, combinations including at least one of the foregoing, and the like. Preferably, the anode 32 comprises a metal oxide catalyst material disposed on a suitable support. For electrolytically exposing chlorine based solutions such as the aqueous sodium chloride solution previously described, it is preferred that a ruthenium oxide based anode be employed. Suitable ruthenium oxide based electrodes are commercially available from the El tech Systems Corporation, Ohio. The supports are typically in the form of a sheet, screen, or the like and are formed from a rigid material such as titanium, niobium, and the like. The cathode 34 may be made from stainless steel, steel or may be made from the same material as the anode 32.

The permselective membranes, e.g., 56, 90, and 92, preferably contain acidic groups so that ions with a positive charge can be attracted and selectively passed through the membranein preference to anions. Preferably, the permselective membranes contain strongly acidic groups, such as $R—SO_3^-$ and are resistant to oxidation and temperature effects. In a preferred embodiment, the permselective membranes are fluoropolymers that are substantially chemically inert to chlorous acid and the materials or environment used to produce the chlorine dioxide. Examples of suitable permselective membranes include perfluorosulfonate cation exchange membranes commercially available under the trade name NAFION commercially available from E.I. duPont de Nemours, Wilmington, Del.

During operation of the electrolytic reactor, it is hypothesized that the function of the cation exchange material includes, among others, electro-actively exchanging or adsorbing alkali metal ions from the aqueous alkali metal chlorite solution and releasing hydrogen ions. The released hydrogen ions can react with the chlorite ions to form chlorous acid and/or can regenerate the cation exchange material back to the hydrogen form thereby releasing alkali metal ions or the like that may then pass into the cathode compartment, if present. The use of the cation exchange material is especially useful when feeding a dilute alkali metal chlorite solution into the central compartment 74 of the three-compartment electrolytic reactor 70 as it helps lower the voltage within the compartment and increases conversion efficiency. When the cation exchange material reaches its exhaustion point or is near exhaustion, it may be readily regenerated by a strong or weak acid so as to exchange the alkali or alkaline earth metal previously adsorbed by the active sites of the cation exchange material for hydrogen. The acid necessary for regenerating the cation exchange material may be added individually at the compartment inlet or may be generated in the anode compartment, which then diffuses across the cation exchange membrane such as may occur during electrolysis of an aqueous based solution flowing through the anode compartment, e.g., a sodium chloride solution. A strong or weak base, e.g., sodium or potassium hydroxide, may be used to regenerate the anionic exchange material, if present.

Examples of suitable cation exchange resins or materials include, but are not intended to be limited to, polystyrene divinylbenzene cross-linked cation exchangers (e.g., strong acid types, weak acid types, iminodiacetic acid types, chelating selective cation exchangers and the like); strong acid perfluorosulfonated cation exchangers; naturally occurring cation exchangers, such as manganese greensand; high surface area macro-reticular or microporous type ion exchange resins having sufficient ion conductivity, and the like. For example, strong acid type exchange materials suitable for use are commercially available from Mitsubishi Chemical under the Diaion trade name. Optionally, the cation exchange material may be further modified, wherein a portion of the ionic sites are converted to semiconductor junctions, such as described in U.S. Pat. Nos. 6,024,850, 5,419,816, 5,705,050 and 5,609,742, herein incorporated by reference in their entireties. However, the use of modified cation exchange material is less preferred because of the inherent costs associated in producing the modification. In a preferred embodiment, the cation exchange materials have a cross-linking density greater than about 8%, with greater than about 25% more preferred and with greater than about 50% even more preferred. Increasing the cross-linking density of the cation exchange materials has been found to increase the resistance of the cation exchange materials to effects of the electrolytic environment such as oxidation and degradation. As a result, operating lifetimes for the electrolytic reactor can advantageously be extended.

The packing density and conductivity of the particulate material 40 disposed within a compartment can be adjusted depending on the operating parameters and desired performance for the electrolytic reactors. For example, the particulate material may be shrunk, if applicable, before use in the electrolytic reactor, such as by dehydration or electrolyte adsorption. Dehydration may be by any method in which moisture is removed from the ion exchange material, for example, using a drying oven. It has been found that dehydration prior to packing can increase the packing density by as much as 40%. Electrolyte adsorption involves soaking the material in a salt solution, such as sodium chloride. The packing density of the material so treated can be increased by as much as 20%. The increase in packing density advantageously increases the volume in which the DC current travels, thus reducing the electrical resistance in the electrolytic reactor.

The particulate material 40 of the electrolytic reactor is not intended to be limited to any particular shape. Suitable shapes include rods, extrudates, tablets, pills, irregular shaped particles, spheres, spheroids, capsules, discs, pellets or the like. In a preferred embodiment, the particulate material is spherical. More preferably, the particulate material includes a reticulated and textured surface having an increased surface area. The sizes of the particulate material 40 employed are dependent on the acceptable pressure drop across the respective bed, i.e., compartment. The smaller the particulate material 40, the greater the pressure drop.

In the preferred application for generating chlorine dioxide, the system 10 is configured with the three-compartment electrolytic reactor 70 as previously described, wherein the central compartment preferably comprises a cation exchange membrane 90 separating the anode compartment 72 from the central compartment 74. Catalyst material or a mixture of catalyst material and cation exchange material is preferably disposed in the central compartment 74.

In operation of the preferred application, an aqueous sodium chloride solution is passed through the anode compartment 72, water is passed through the cathode compartment 76, and a dilute aqueous feed solution of an alkali metal chlorite solution is passed through the central compartment 74. Preferably, the water employed to make the solutions as well as the water passed through the cathode compartment is deionized. As a direct current is applied to the reactor 70, the following reactions are believed to take place within each compartment, among others:

(I) Anode Compartment

Oxidation of the chloride ion occurs at the anode:

a. $2Cl^- \rightarrow Cl_2 + 2e^-$

Followed by a rapid hydrolysis of the chlorine:

b. $Cl_2 + H_2O \rightarrow HOCl + HCl$

HOCl then undergoes partial dissociation as follows:

c. $HOCl \rightarrow H^+ + OCl^-$

Oxidation of water also occurs at the anode:

d. $2H_2O \rightarrow O_2 + 4H^+ + 4e^-$ (II) Cathode Compartment

Reduction of water occurs at the cathode:

a. $2H_2O+2e^- \rightarrow 2OH^-+H_2$ (III) Central Compartment a. $2NaClO_2+Cl_2 \rightarrow 2ClO_2+2NaCl$ b. $2NaClO_2+HOCl \rightarrow HCl+2ClO_2+H_2O-2NaCl$ c. $5NaClO_2+4H^+ \rightarrow 4ClO_2+Cl^-+2H_2O$ As shown by the equations, it is believed that chlorine gas is initially formed at the anode surface to establish the equilibrium reactions of (Ib) and (Ic). With a selected current density and anode design, electrolysis of water produces hydrogen ions in accordance with (Id). The hydrogen ions so produced combine with the free available chloride ions to form hydrochloric acid. In the central compartment, sodium chlorite is blended with the anode effluent. Chlorine dioxide is generated by two reactions depending on the equilibrium established in the anode compartment as shown by (IIIa) and/or III(b). A third reaction mechanism as shown in (IIIc) can occur when the central compartment contains cation exchange resin in the hydrogen form. In this mechanism, chlorous acid is generated from the sodium chlorite solution by hydrogen exchange with sodium ions. The type of particulate material contained within the central compartment, i.e., catalyst material, cation exchange material, or a mixture of varying proportions of the catalyst material and the cation exchange material can be used to control the equilibriums of the various reactions. In a preferred embodiment, the chlorine dioxide product produced contains at least 90 percent by weight of chlorine dioxide relative to all chlorine species produced in the chlorine dioxide product.

In the cathode compartment, sodium ions enter the cathode compartment from the central compartment where they combine with hydroxyl ions to form a sodium hydroxide effluent. The effluent along with the hydrogen (H) generated by electrolysis of water in the cathode compartment is preferably removed from the system, e.g., directed to a drain, vented, and the like.

The concentration of chlorine dioxide produced by the electrolytic reactor, e.g. is preferably less than about 5.0 grams per liter (g/L), with less than about 4.0 g/L more preferred. At concentrations greater than about 4.0 to 5.0 g/L, aqueous chorine dioxide solutions are inherently unstable. Moreover, at concentrations greater than about 6.0 g/L, there is an increased risk of producing chlorine dioxide in the vapor phase as the chlorous acid solution is oxidized in the fixed bed reactor 200, which undesirably can cause an explosion referred to by those skilled in the art as a "puff".

There are a number of variables that may be optimized during operation of the system. For example, a current density for the electrolytic reactors is preferably maintained at about 5 to about 100 milliAmps per square centimeter ($mA/cm^2$). More preferably, the current density is less than about 50 $mA/cm^2$, with less than about 35 $mA/cm^2$ even more preferred. Also preferred, are current densities greater than about 10 $mA/cm^2$, with greater than about 25 $mA/cm^2$ more preferred. The temperature at which the feed solutions (e.g., alkali metal chlorite solution, water, and the like solutions) is maintained can vary widely. Preferably, the temperature is less than about 50° C., less than about 25° C. even more preferred. Also preferred is a temperature greater than about 2° C., with greater than about 5° C. more preferred, and with greater than about 10° C. even more preferred. In a preferred embodiment, the process is carried out at about ambient temperature.

In addition to temperature and current density, the contact time of the alkali metal chlorite solution with the cation exchange material is preferably less than about 20 minutes and more preferably, less than about 2 minutes. Also preferred is a contact time greater than about 1 minute, with greater than about 0.1 minute more preferred. Similarly, the contact time of the chlorous acid containing effluent with the redox exchanger material is preferably less than about 20 minutes and more preferably, less than about 2 minutes. Also preferred is a contact time greater than about 1 minute, with greater than about 0.1 minute more preferred. The velocity of the chlorine dioxide precursor solution through the electrolytic reactor and/or fixed bed reactor is preferably less than about 100 centimeters/minute (cm/min), with less than about 70 cm/min more preferred and less than about 30 cm/min more preferred. Also preferred is a velocity greater than about 0.1 cm/min, with greater than about 10 cm/min more preferred and with greater than about 20 cm/min even more preferred. The pressure drop through the electrolytic reactor and/or fixed bed reactor is preferably less than about 20 pounds per square inch (psi) and for most applications, with less than about 10 psi more preferred. Also preferred is a pressure drop greater than about 0.1 psi, and for most applications, with greater than about 1 psi more preferred. Further optimization for any of these process variables is well within the skill of those in the art in view of this disclosure.

The disclosure is further illustrated by the following non-limiting Examples.

EXAMPLE 1

In this Example, a system for generating chlorine dioxide was configured as described in FIG. 1.

The electrolytic reactor was configured as shown and described in FIG. 1. Each compartment employed a length of 25.4 centimeters (cm) with a width of 5.08 cm. The thickness of the central compartment was 1.27 cm and the thicknesses of the electrode compartments were 0.64 cm. The electrode and central compartments of the electrolytic reactor contained SK116 cation exchange resin commercially available from Mitsubishi Chemical. A transverse DC electric field was supplied by an external power supply to the electrodes. Sodium chloride at a concentration of about 350 mg/L was fed to the anode compartment at a flow rate of about 200 milliliters per minute. The effluent from the anode compartment was coupled to the inlet of the central compartment; thereby diluting a 25-weight percent sodium chlorite feed solution such that the final concentration of sodium chlorite was about 1,000 mg/L as it entered the central compartment. The weight ratio of sodium chlorite to sodium chloride was about 3 to 1. The temperature of the feed solution was held constant at about 30° C.

Softened water was passed upwardly through the cathode compartment of the electrolytic reactor at a flow rate of about 200 mL/min. While passing the respective solutions through the various compartments of the reactor, a controlled current of about 4.5 amps was applied to the anode and cathode. The system was operated continuously for a period of about 1,000 hours with the flowing parameters measured at about 150 hour intervals: current, voltage, pressure, temperature, chlorine dioxide flow rate, sodium chlorite flow rate, chlorine dioxide concentration, and chlorine dioxide effluent pH.

A Direct Reading Spectrophotometer, Model No. DR/2010, was used to measure the chlorine dioxide concentration (mg/L) in the solution exiting the electrolytic reactor using Method 8138. For calibration, a pure chlorine dioxide solution was prepared and titrated in accordance with Iodometric Method 4500-$ClO_2$ E as described in the Standard Methods for the Examination of Water and Wastewater, 18th edition, 1998. Prior to calibration, the UV bulb for the spectrophotometer was replaced and the wavelength calibrated in accordance with the manufacturer's recommendations. Using the pure chlorine dioxide solution obtained from Method 4500-$ClO_2$ E, the spectrophotometer was then given a calibration factor where it deviated from the titrated chlorine dioxide concentration.

Figure 4:
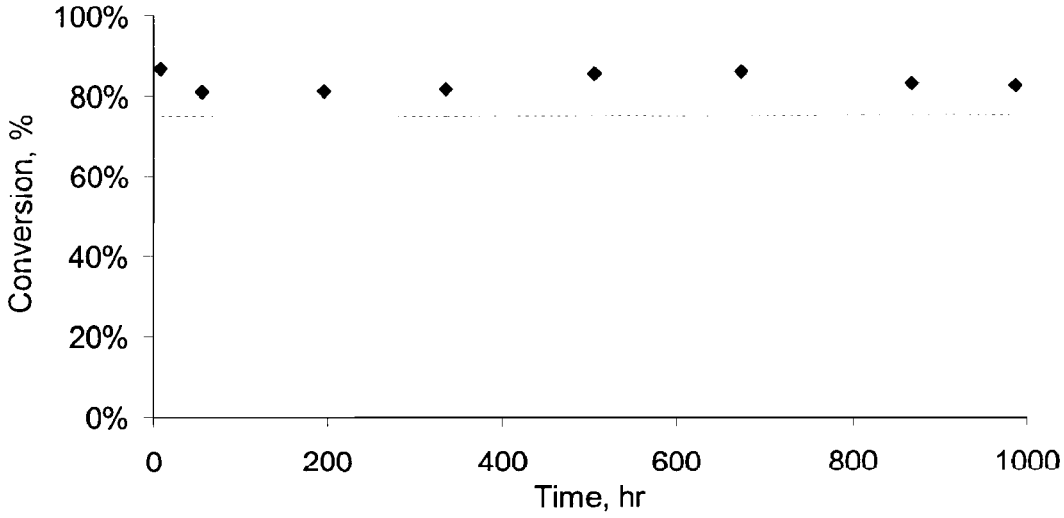
FIG. 4 graphically illustrates percent conversion of chlorine dioxide from the sodium chloride and sodium chlorite solutions as a function of time.
Figure 5:
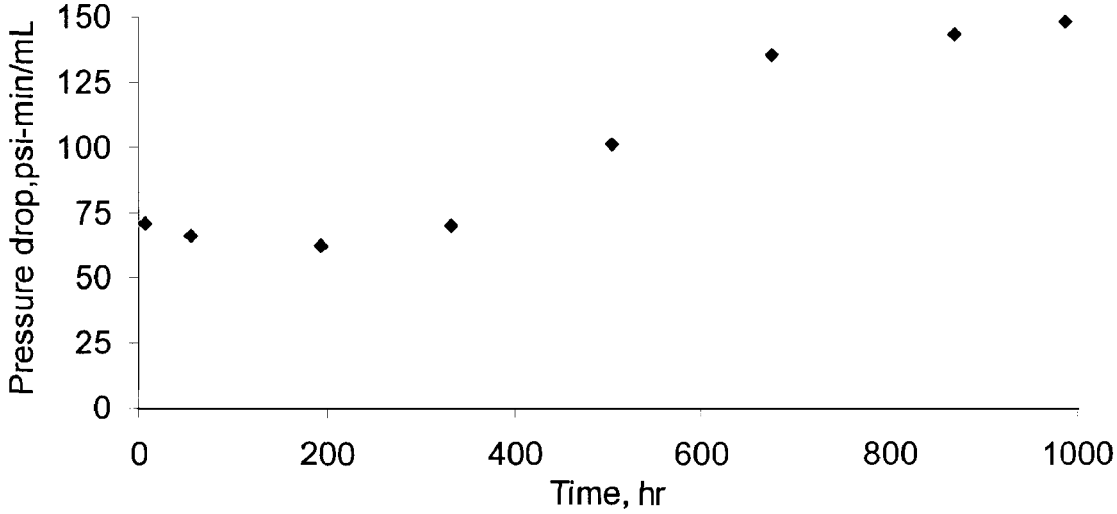
FIG. 5 graphically illustrates pressure drop as a function of time for a chlorine dioxide process in accordance with the present disclosure.

FIGS. 4 and 5 graphically illustrate percent conversion and pressure drop as a function of time for the above noted process. It has been observed that percent conversion increases as a result of directing the sodium chloride feedstream to the anode compartment. Without the addition of the sodium chloride feedstream to the anode compartment, percent conversion was about 75 percent as indicated by the dotted line in FIG. 4. Accordingly, measurement of the various parameters discussed above indicates that the reaction in the central compartment proceeds in accordance with Equations (IIIa) and/or (IIIb) described above. In the anode compartment, $Cl_2$ is generated, which reacts with sodium chlorite ($NaClO_2$) in the central compartment to generate chlorine dioxide The use of sodium chloride advantageously increases the percent conversion beyond that expected for sodium chlorite to chlorine dioxide conversion alone.

While the disclosure has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the disclosure without departing from the essential scope thereof, such as for producing other halogen oxides. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A process for producing chlorine dioxide, the process comprising:

feeding an aqueous alkali metal chloride solution into an anode compartment of an electrolytic reactor, wherein the electrolytic reactor comprises the anode compartment comprising an anode, a cathode compartment comprising a cathode, and a central compartment positioned between the anode and cathode compartments, wherein the central compartment comprises a particulate material;

feeding an effluent from the anode compartment and an aqueous alkali metal chlorite solution into the central compartment of an electrolytic reactor; and applying a current to the electrolytic reactor to produce an effluent containing chlorine dioxide from the central compartment, wherein the chlorine dioxide is at a percent conversion greater than 75 percent based on an amount of the alkali metal chlorite.

2. The process of claim 1, wherein the effluent from the anode compartment comprises hypochlorous acid and hydrogen chloride.

3. The process of claim 1, wherein the particulate material comprises a catalyst material, a cation exchange material, or a mixture of the cation exchange material and the catalyst material.

4. The process according to claim 3, wherein the cation exchange material has a cross linking density greater than about 8 percent.

5. The process of claim 1, wherein the alkali metal chlorite solution has a concentration after introduction of the effluent from the anode compartment of less than about 10,000 milligrams alkali metal chlorite per liter of solution.

6. The process according to claim 1, wherein the alkali metal chlorite solution has a concentration after introduction of the effluent from the anode compartment of less than about 5,000 milligrams alkali metal chlorite per liter of solution.

7. The process according to claim 1, wherein the alkali metal chlorite solution has a concentration after introduction of the effluent from the anode compartment of less than about 1,500 milligrams alkali metal chlorite per liter of solution.

8. The process according to claim 1, wherein the effluent containing the chlorine dioxide contains at least 90 percent by weight of chlorine dioxide relative to all chlorine species produced in the chlorine dioxide product.

9. The process according to claim 1, wherein the aqueous alkali metal chloride solution contains less than about 20.0 grains alkali metal chloride per liter of solution.

10. A process for producing chlorine dioxide from an alkali metal chlorite solution, the process comprising:

applying a current to an electrolytic reactor, wherein the electrolytic reactor includes an anode compartment comprising an anode, a cathode compartment comprising a cathode, and a central compartment positioned between the anode and cathode compartments, wherein the central compartment comprises a cation exchange material and is separated from the cathode compartment with a cation exchange membrane;

feeding an aqueous sodium chloride solution to the anode compartment;

electrolyzing the aqueous sodium chloride solution in the anode compartment to produce a hydrogen chloride and/or a hypochlorous acid containing effluent; and feeding the hydrogen chloride and/or the hypochlorous acid containing effluent and an alkali metal chlorite solution into the central compartment to produce a chlorine dioxide effluent from the central compartment, wherein the chlorine dioxide is at a percent conversion greater than 75 percent based on an amount of the alkali metal chlorite.

11. The process of claim 10, wherein the chlorine dioxide effluent contains at least about 90 percent by weight of chlorine dioxide with respect to all chlorine species in the chlorine dioxide effluent.

12. The process according to claim 10, wherein the alkali metal chlorite solution is selected from the group consisting of lithium chlorite, sodium chlorite and potassium chlorite.

13. The process according to claim 10, wherein the effluent containing the hydrogen chloride and/or the hypochlorous acid has a pH of about 1 to about 5.

14. The process according to claim 10, wherein the central compartment further comprises a catalyst material comprises an oxide of a noble metal and a ceramic support.

15. A process for producing chlorine dioxide from an alkali metal chlorite solution, the process comprising:

applying a current to an electrolytic reactor, wherein the electrolytic reactor includes an anode compartment comprising an anode, a cathode compartment comprising a cathode, and a central compartment positioned between the anode and cathode compartments, wherein the central compartment comprises a cation exchange material and is separated from the cathode compartment with a cation exchange membrane;

feeding an aqueous sodium chloride solution to the anode compartment;

electrolyzing the aqueous sodium chloride solution in the anode compartment to produce a chlorine gas containing effluent; and feeding the chlorine gas containing effluent and an alkali metal chlorite solution into the central compartment to produce a chlorine dioxide containing effluent from the central compartment, wherein the chlorine dioxide is at a percent conversion greater than 75 percent based on an amount of the alkali metal chlorite.

16. The process of claim 15, wherein the chlorine dioxide containing effluent contains at least about 90 percent by weight of chlorine dioxide with respect to all chlorine species in the chlorine dioxide effluent.

17. The process of claim 15, wherein the chlorine gas containing effluent further comprises hydrogen chloride and hypochlorite.

18. The process of claim 15, wherein the cation exchange material has a cross linking density of at least 8 percent.

19. The process of claim 15, wherein the aqueous sodium chloride solution contains less than about 20.0 grams sodium chloride per liter of solution.

* * * * *